US007330204B2

(12) United States Patent
Ohno

(10) Patent No.: US 7,330,204 B2
(45) Date of Patent: Feb. 12, 2008

(54) SELF-SCANNING LIGHT-EMITTING ELEMENT ARRAY AND DRIVING METHOD OF THE SAME

(75) Inventor: Seiji Ohno, Minato-ku (JP)

(73) Assignee: Fuji Xerox Co., Ltd., Tokyo (JP)

( * ) Notice: Subject to any disclaimer, the term of this patent is extended or adjusted under 35 U.S.C. 154(b) by 290 days.

(21) Appl. No.: 11/103,226

(22) Filed: Apr. 11, 2005

(65) Prior Publication Data

US 2005/0230704 A1 Oct. 20, 2005

(30) Foreign Application Priority Data

Apr. 14, 2004 (JP) ..... 2004-118759

(51) Int. Cl.
*B41J 2/45* (2006.01)

(52) U.S. Cl. ..... 347/238

(58) Field of Classification Search ..... 347/238, 347/237

See application file for complete search history.

(56) References Cited

U.S. PATENT DOCUMENTS 6,531,826 B1 * 3/2003 Ohno et al. ..... 315/169.3
6,703,790 B2 * 3/2004 Ohno ..... 315/169.3
6,747,940 B2 * 6/2004 Ohno ..... 369/121
2004/0046976 A1 * 3/2004 Ohno et al. ..... 358/1.8
2004/0135875 A1 * 7/2004 Wakisaka ..... 347/238

FOREIGN PATENT DOCUMENTS

| | | |
|---|---|---|
| JP | 1-238962 | 9/1989 |
| JP | 2-14584 | 1/1990 |
| JP | 2-92650 | 4/1990 |
| JP | 2-92651 | 4/1990 |
| JP | 2-263668 | 10/1990 |

* cited by examiner

*Primary Examiner*—Hai Pham
*Assistant Examiner*—Kainoa Wright
(74) *Attorney, Agent, or Firm*—RatnerPrestia

(57) ABSTRACT

A self-scanning light-emitting element array is driven such that, if a current supply line for a light-emitting element is broken, a light-emitting element neighboring failed light-emitting element continues to operate. In first time period turned-on states of the neighboring two thyristor overlap when the turned-on state is transferred in the transfer portion by the two-phase clock pulses; a second time period is provided after the first period, during which the light-emitting thyristor corresponding to the turned-on thyristor in the transfer portion is lighted by the light-emitting signal; in a third time period, after the second time period, a turned-off transfer thyristor for the turned-on thyristor is turned on and the lighted thyristor in the light-emitting portion is lighted out. The second time period has a length in which the thyristor having the broken line neighboring the failed thyristor is lighted.

4 Claims, 9 Drawing Sheets

SELF-SCANNING LIGHT-EMITTING ELEMENT ARRAY AND DRIVING METHOD OF THE SAME

BACKGROUND OF THE INVENTION

1. Field of the Invention

The present invention relates to a method for driving a self-scanning light-emitting element array, particularly to a method for driving a self-scanning light-emitting element array in which an effect to an image is not caused even if there is a thyristor which is not lighted in a light-emitting portion due to the breakage of a current supply line for thyristors in the light-emitting portion.

2. Related Art

A light-emitting element array in which a plurality of light-emitting elements are integrated on the same substrate is utilized as an optical writing head for an optical printer and the like with combining it to a driving IC. The inventors of the present invention have interested in a three-terminal light-emitting thyristor having a pnpn-structure as a component of the self-scanning light-emitting element array, and have already filed several patent applications (see Japanese Patent Publication Nos. 1-238962, 2-14584, 2-92650, and 2-92651) showing that a self-scanning operation for the thyristors in a light-emitting portion may be realized. These publications have disclosed that such a self-scanning light-emitting element array has a simple and compact structure for a light source of a printer, and has smaller arranging pitch of light-emitting elements.

The inventors have further provided a self-scanning light-emitting device having such structure that a transfer portion including switch elements (light-emitting thyristors) array is separated from a light-emitting portion including light-emitting elements (light-emitting thyristors) array (see Japanese Patent Publication No. 2-263668).

Referring to FIG. 1A, there is shown an equivalent circuit diagram of a self-scanning light emitting array in which a transfer portion and light-emitting portion are separated. The self-scanning light-emitting element array comprises a transfer portion including thyristors $S_1$, $S_2$, $S_3$ . . . and a light-emitting portion including thyristors $L_2$, $L_2$, $L_3$ . . . . The structure of the transfer portion utilizes a diode-coupling system, i.e., the neighbored gates of the thyristors $S_1$, $S_2$, $S_3$ . . . are connected by diodes $D_1$, $D_2$, $D_3$ . . . , respectively. A power Supply VGA is connected to gate $g_1$, $g_2$, $g_3$ . . . in the transfer portion through gate load resistors $R_{g1}$, $R_{g2}$, $R_{g3}$, respectively. Respective gates $g_1$, $g_2$, $g_3$ . . . of the thyristors $S_1$, $S_2$, $S_3$ . . . are also connected corresponding gates $g'_1$, $g'_2$, $g'_3$ of the thyristors $L_1$, $L_2$, $L_3$ in the light-emitting portion through resistors $R_{p1}$, $R_{p2}$, $R_{p3}$ . . . . Respective cathodes of the thyristors in the transfer portion are connected alternately to ϕ1 line 12 and ϕ2 line 14.

Current limiting resistors R1 and R2 are inserted in the ϕ1 line 12 and ϕ2 line 14, respectively.

Respective cathodes of the thyristors $L_1$, $L_2$, $L_3$ . . . in the light-emitting portion are connected to a light-emitting signal $\phi_I$ line 16. A current limiting resistor $R_I$ is inserted in the $\phi_I$ line 16.

By driving the self-scanning light-emitting element array thus structured, a thyristor in the light emitting portion designated by the turned-on state of a thyristor in the transfer portion driven by two-phase clock pulses ϕ1 and ϕ2 is lighted or lighted out to make an image.

In FIG. 1B, there shown High/Low-level of the clock pulses ϕ1, ϕ2 and the light-emitting signal $\phi_I$, turned-on/turned-off state of the thyristors in the transfer portion, and lighted/lighted out state of the thyristors in the light-emitting portion. As shown in FIG. 1B, a time period during which both clock pulses ϕ1 and ϕ2 are at Low-level is shown by $t_a(=t_3-t_2)$, a time period until when the light-emitting signal $\phi_I$ becomes Low-level after any of clock pulses ϕ1 and ϕ2 becomes High-level is shown by $t_b(=t_4-t_3)$, and a transfer period is shown by $T(=t_5-t_2)$. Herein, a time when the light-emitting signal $\phi_I$ becomes High-level is set equally to a time when next clock pulse becomes Low-level to increase a light-emitting period. As a result, the light-emitting time period is equal to $(T-t_a-t_b)$.

As an example, a transfer period $T=t_5-t_2=500$ ns, a time period $t_a=t_3-t_2=20$ ns, and a time period $t_b=t_4-t_3=20$ ns.

As a line for supplying a current to the thyristors in the light-emitting portion is thin in its width and the density of a current through it is large, there is a possibility of the breakage of the line due to an electro-migration. In a conventional drive method, the transfer operation becomes unstable when the breakage of a line is caused, and the thyristors succeeding the breakage point in a transfer direction in the light-emitting portion may not be lighted. In such a case, an image defect will be caused in which a part of an image is not printed across several mili meters in width (i.e., white stripe) for the worst case, which depends on the breakage point. This defect will be remarkable in a printed image. As a color printer having a printing density of 1200 dpi (dots per inch) for A3 size comprises a print head including 60,000 thyristors in the light emitting portion, a serious image defect will be caused even if only one current supply line for the thyristors in a light-emitting portion is broken. Therefore, a high reliability is required for respective thyristors in the light-emitting portion, resulting in a cost up of a print head.

The reason why an abnormal transfer operation is caused will now be described hereinafter. As shown in FIG. 2A, it is assumed that a cathode line for the thyristor $L_5$ in a light-emitting portion is broken. FIG. 2B shows High/Low-level of the clock pulses ϕ1, ϕ2 and the light-emitting signal $\phi_I$, turned-on/turned-off state of the thyristors in the transfer portion, and lighted/lighted out state of the thyristors in the light-emitting portion.

As shown in FIG. 2B, it is assumed that when the clock pulse ϕ1 is at High-level, the clock pulse ϕ2 is at Low-level, and the light-emitting signal $\phi_I$ Low-level at the time $t_1$, the thyristor $S_4$ in the transfer portion is turned on, and the thyristor $L_4$ in the light-emitting portion is lighted. At the time $t_2$, the clock pulse ϕ1 becomes Low-level, and the light-emitting signal $\phi_I$ High-level, so that the thyristor $S_5$ is turned on, and the thyristor $L_4$ is lighted out. Subsequently, at the time $t_3$, the clock pulse ϕ2 becomes High-level, and the thyristor $S_4$ is turned off. Subsequently, while the light-emitting signal $\phi_I$ becomes Low-level at the time $t_4$, the thyristor $L_5$ connected to the turned-on thyristor $S_5$ may not be lighted due to the breakage of the line. At this time, one thyristor among the thyristors $L_1$-$L_6$ in the light-emitting portion connected to the $\phi_I$ line 16 is turned on, the gate voltage of the one thyristor having the highest voltage among the gate voltages on the gates $g'_1$–$g'_6$.

FIG. 3 shows the variation of voltages of the gates $g_4$, $g_6$, $g'_4$, $g'_6$ after the time $t_2$. While the light-emitting signal $\phi_I$ becomes High-level at the time $t_2$ to light out the thyristor $L_4$, the voltages of the gate $g'_4$ as well as the gate $g_4$ becomes approximately 0 volts because the clock pulse ϕ2 is still at Low-level. When the clock pulse ϕ2 becomes High-level at the time $t_3$, the thyristor $S_4$ is also turned off and then the gates $g_4$ and $g'_4$ are pulled down through the resistors $R_{g4}$ and $R_{p4}$, so that respective voltages of the gates $g_4$ and $g'_4$ are decreased at the time constants $\tau_g$ and $\tau'_g$ toward the voltage $V_{GA}$ (−5 volts). In FIG. 3, the voltages of the gates $g_4$ and $g'_4$ at the time $t_4$ are designated by $g_4$ ($t_4$) and g'4 ($t_4$), respectively. At this time, the resistance of the gate $g'_4$ is larger than that of the gate $g_4$, so that the time constant $\tau'_g$ becomes larger to cause the rate of voltage decreasing to be slow.

On the other hand, the thyristor $S_5$ is turned on at the time $t_2$, so that respective voltages of the gates $g_6$ and $g'_6$ become approximately $-V_D$ ($V_D$ is a forward rising voltage of the coupling diode D). Subsequently, when the light-emitting signal $\phi_I$ becomes Low-level at the time $t_4$, respective voltages of the gates $g'_4$, $g'_5$ and $g'_6$ become as follows:

the voltage of the gate $g'_4=g'_4(t_4)$ the voltage of the gate $g'_5$=about 0 volts the voltage of the gate $g'_6=g'_6(t_4)$.

As the voltage of the gate g'5 is highest, the thyristor $L_5$ will be lighted in a normal case. However, the thyristor $L_5$ may not be lighted because the cathode line for the thyristor $L_5$ is broken. In this case, the thyristor having the higher voltage between the gate voltage $g'_4(t_4)$ and $g'_6(t_4)$ is lighted. As $g'_4(t_4)>g'_6(t_4)$ in FIG. 3, the thyristor $L_4$ is lighted again. At this time, the thyristor S5 is turned on in the transfer portion and the thyristor $L_4$ is lighted in the light-emitting portion, which is an unstable state.

Subsequently, the clock pulse $\phi$2 becomes Low-level at the time $t_5$. In a normal state, the gate voltage $g_6$ ($t_5$) is approximately $-V_D$ which is the highest gate voltage among the thyristors connected to the clock pulse $\phi$2 line 14. However, the thyristor $L_4$ is lighted, so that the voltage of the gate $g_4$ is a voltage divided by the resistors $R_{p4}$ and $R_{g4}$. In the case of $R_{p4}$=5 kΩ, $R_{g4}$=20 kΩ for example, the voltage $g_4$ ($t_5$) is approximately −1 volts. As a result, the light-emitting $\phi_I$ signal becomes High-level, and then $g_4(t_5)>g_6$ ($t_5$) at the time $t_5$ when the thyristor $L_4$ is lighted out. Consequently, the thyristor $S_4$ is turned on as shown in FIG. 3B. When the light-emitting signal $\phi_I$ becomes Low-level at the time $t_7$, the thyristor $L_4$ is lighted again. The situation described above is repeated hereinafter, so that the thyristor $L_4$ is lighted repeatedly and the thyristors after the thyristor $L_5$ in the light-emitting portion are not lighted. The transfer operation of the thyristors in the light-emitting portion is stopped, resulting in the defect of white stripe in printing.

SUMMARY OF THE INVENTION

The object of the present invention is to provide a method for driving a self-scanning light-emitting element array in which even if a line in a light-emitting portion is broken, a thyristor neighbored to the failed thyristor having the breakage of the line may be lighted to continue the transfer of a lighted state of the thyristor.

The present invention is a method for driving a self-scanning light-emitting element array including a transfer portion in which a plurality of three-terminal light-emitting thyristors are arrayed in one dimension, gates of neighbored thyristors are connected by a diode respectively, a power supply is connected to each gate of the thyristors through a load resistor, a first and second clock pulses of two phases are alternately supplied to cathodes or anodes of the thyristors; a light-emitting portion in which a plurality of three-terminal light-emitting thyristors are arrayed in one dimension, each gate of the thyristors is connected to a gate of corresponding thyristor in the transfer portion through a resistor, and a light-emitting signal is supplied to cathodes or anodes of the thyristors.

According to the first aspect of the present invention, the method comprises the steps of:

turning on the thyristors in the transfer portion sequentially by the two-phase clock pulses;

lighting the thyristor in the light-emitting portion corresponding to the turned-on thyristor in the transfer portion by the light-emitting signal;

a first time period is provided, during which turned-on states of neighbored two thyristors are overlapped when the turned-on state is transferred in the transfer portion by the two-phase clock pulses;

a second time period is provided after the first time period, during which the thyristor in the light-emitting portion corresponding to the turned-on thyristor in the transfer portion is lighted by the light-emitting signal;

a third time period is provided after the second time period, during which a turned-off thyristor back to the turned-on thyristor in the transfer portion is turned on as well as the lighted thyristor in the light-emitting portion is lighted out; and the second time period is a time period having a length in which when a thyristor to be lighted in the light-emitting portion is not lighted due to the breakage of a line, a thyristor back to the failed thyristor due to the breakage of the line is lighted.

According to the second aspect of the present invention, the method comprises the steps of:

turning on the thyristors in the transfer portion sequentially by the two-phase clock pulses;

lighting the thyristor in the light-emitting portion corresponding to the turned-on thyristor in the transfer portion by the light-emitting signal;

a first time period is provided, during which turned-on states of neighbored two thyristors are overlapped when the turned-on state is transferred in the transfer portion by the two-phase clock pulses;

a second time period is provided after the first time period, during which the thyristor in the light-emitting portion corresponding to the turned-on thyristor in the transfer portion is lighted by the light-emitting signal;

a third time period is provided after the second time period, during which the lighted thyristor in the light-emitting portion is lighted out;

a fourth time period is provided after the third time period, during which a thyristor back to the turned-on thyristor in the transfer portion is turned on; and the fourth time period is a time period having a length in which when a thyristor to be lighted in the light-emitting portion is not lighted due to the breakage of a line, a thyristor back to the failed thyristor due to the breakage of the line is lighted.

BEST MODE FOR CARRYING OUT THE INVENTION

An embodiment in accordance with the present invention will now be described for an anode common type using a P-type substrate. It is noted that the present invention may be applied to a cathode common type accompanying with a suitable modification.

Instead of the failed thyristor having a broken line in the light-emitting portion, the thyristor prior to or back to the failed thyristor is lighted to allow a normal operation hereinafter. Therefore, the total number of lighted thyristors is not varied and the position to be lighted is shifted only one dot from the original position, resulting in a less remarkable defect.

There are following two methods to realize the normal operation.

(1) The time period $\tau_b(=t_4-t_3)$ is selected to be equal to or larger than the time period $\tau_b$. As a result, when the breakage of a line is caused, the thyristor $L_{n+1}$ back to the failed thyristor $L_n$ having the broken line may be necessarily lighted. It is noted that $\tau_b$ is the time period required for the voltage of the gate $g'_{n+1}$ of the thyristor $L_{n+1}$ becoming larger than the voltage of the gate $g'_{n-1}$ of the thyristor $L_{n-1}$.

(2) The time period $t_c$ is provided between the time when the light-emitting signal $\phi_I$ becomes High-level and the time when both of the clock pulses $\phi$1 and $\phi$2 become Low-level, $t_c$ being larger than the time period $\tau_c$. As a result, even if the breakage of a line is caused and the thyristor $L_{n-1}$ prior to the failed thyristor $L_n$ having the broken line is lighted in place of the thyristor $L_n$, the lightening of the thyristors after the thyristor $L_{n+1}$ may be transferred normally. It is note that $\tau_c$ is the time period required for the voltage of the gate $g_{n+1}$ of the thyristor $S_{n+1}$ becoming larger than the voltage of the gate $g_{n-1}$ of the thyristor $S_{n-1}$ at the timing when both of the clock pulses $\phi$1 and $\phi$2 become Low-level.

Embodiment 1

Figure 1A:
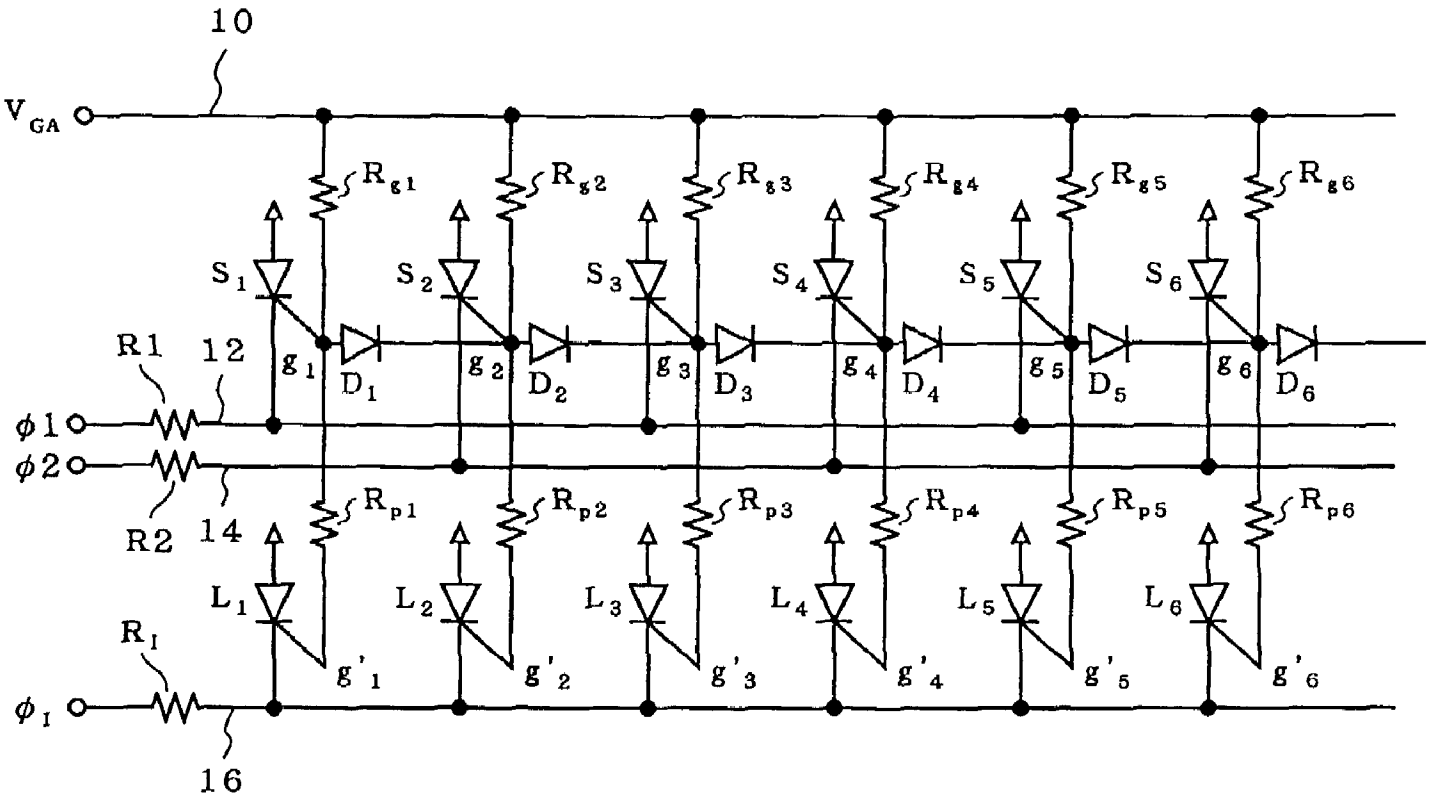
FIG. 1A shows an equivalent circuit diagram of a conventional self-scanning light emitting array.
Figure 1B:
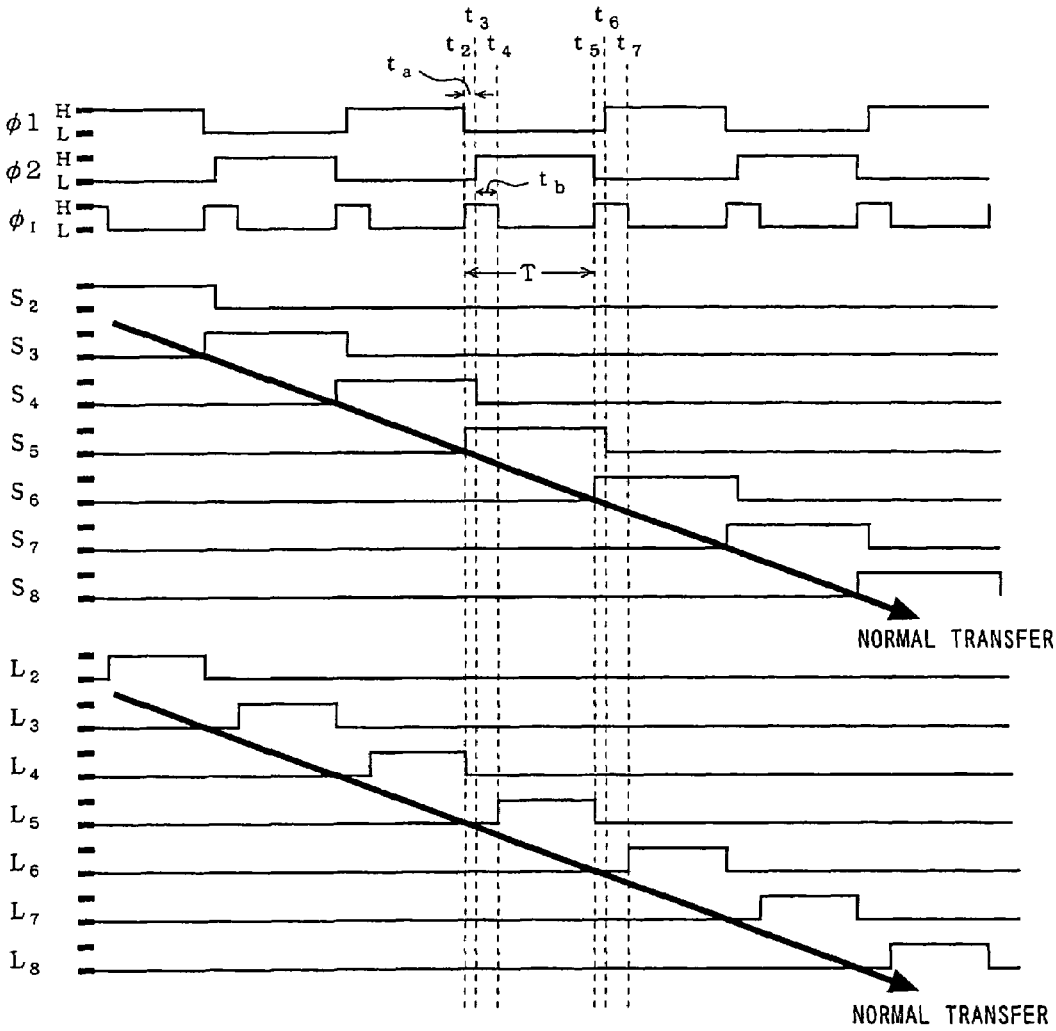
FIG. 1B shows the waveforms illustrating the operation of the self-scanning light-emitting element array in FIG. 1A.
Figure 2A:
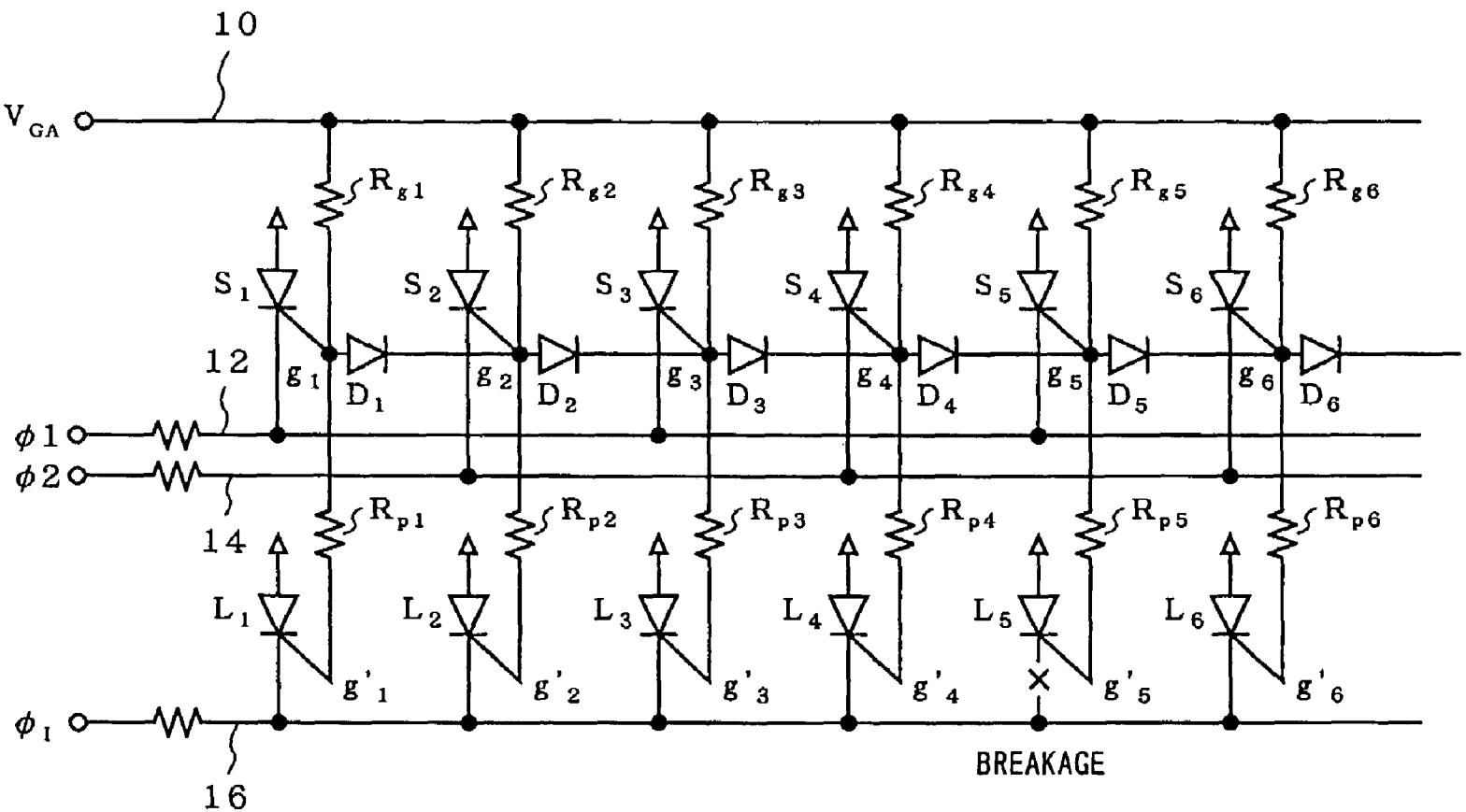
FIG. 2A shows an equivalent circuit diagram of a self-scanning light emitting array in which a cathode line for the thyristor $L_5$ in a light-emitting portion is broken.
Figure 2B:
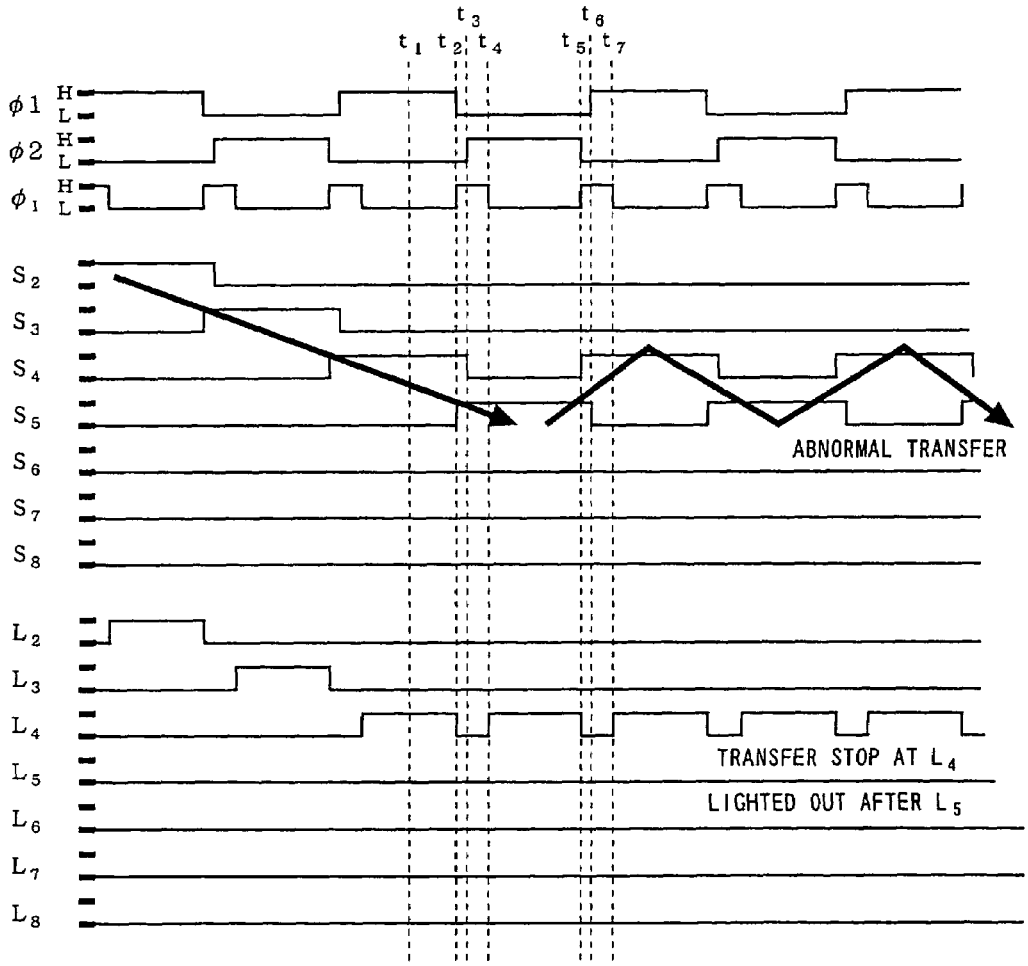
FIG. 2B shows the waveforms illustrating the operation of the self-scanning light-emitting element array in FIG. 2A.

The present embodiment is on the basis of the method (1) described above. In the conventional waveforms shown in FIG. 1B, the length of the time period $t_b$ is selected to be shortest for the normal operation of thyristors in the light-emitting portion. If the time period $t_b$ is selected to be larger than b which, in the case of the failed thyristor being the thyristor $L_n$, is the time period required for the voltage of the gate $g'_{n+1}$ of the thyristor $L_{n+1}$ back to the thyristor $L_n$ becoming larger than the voltage of the gate $g'_{n-1}$ of the thyristor $L_{n-1}$ prior to the thyristor $L_n$, the thyristor $L_{n+1}$ back to the failed thyristor $L_n$ may be necessarily lighted.

Figure 4:
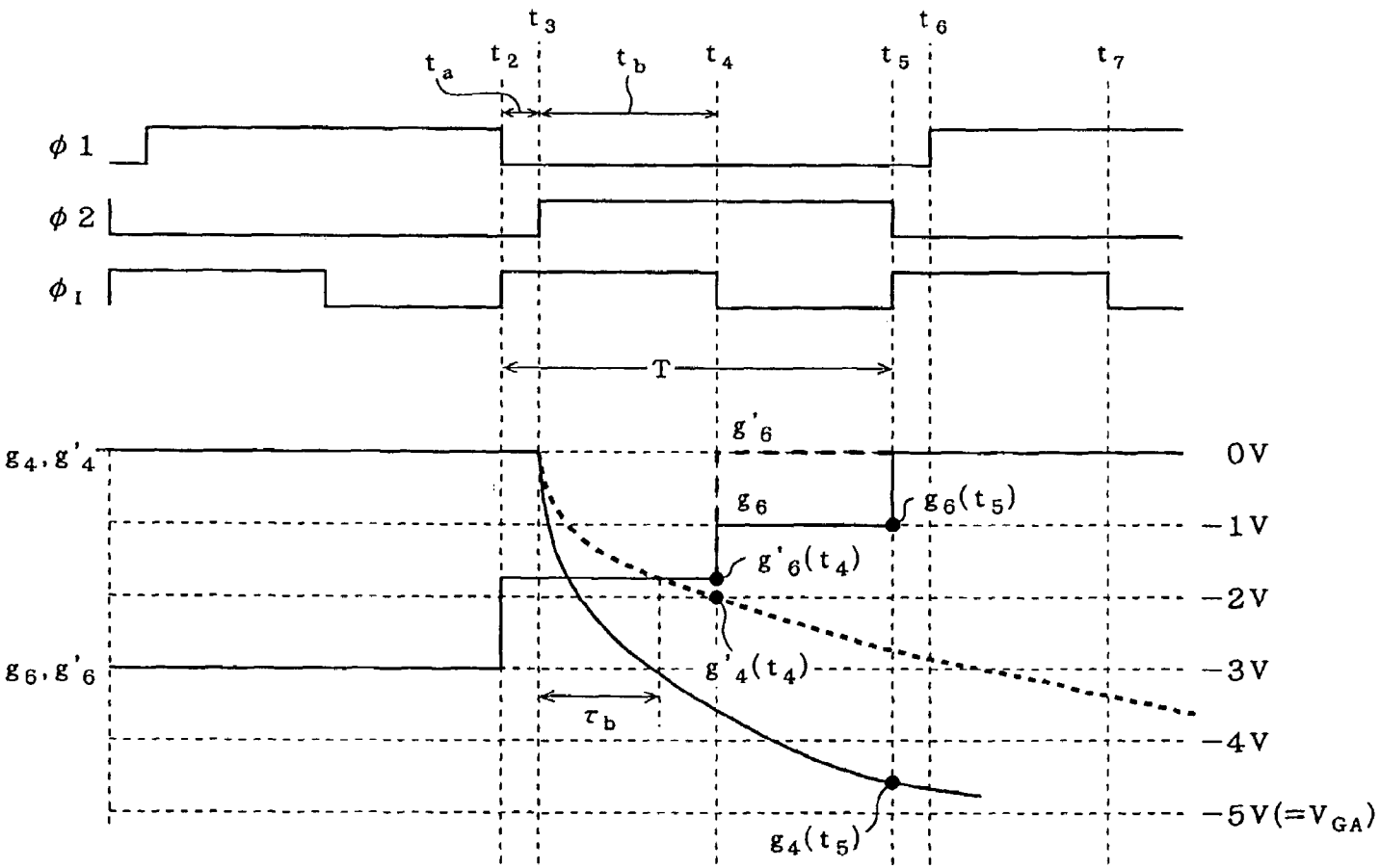
FIG. 4 shows the waveforms for illustrating the drive method in the embodiment 1.
Figure 5:
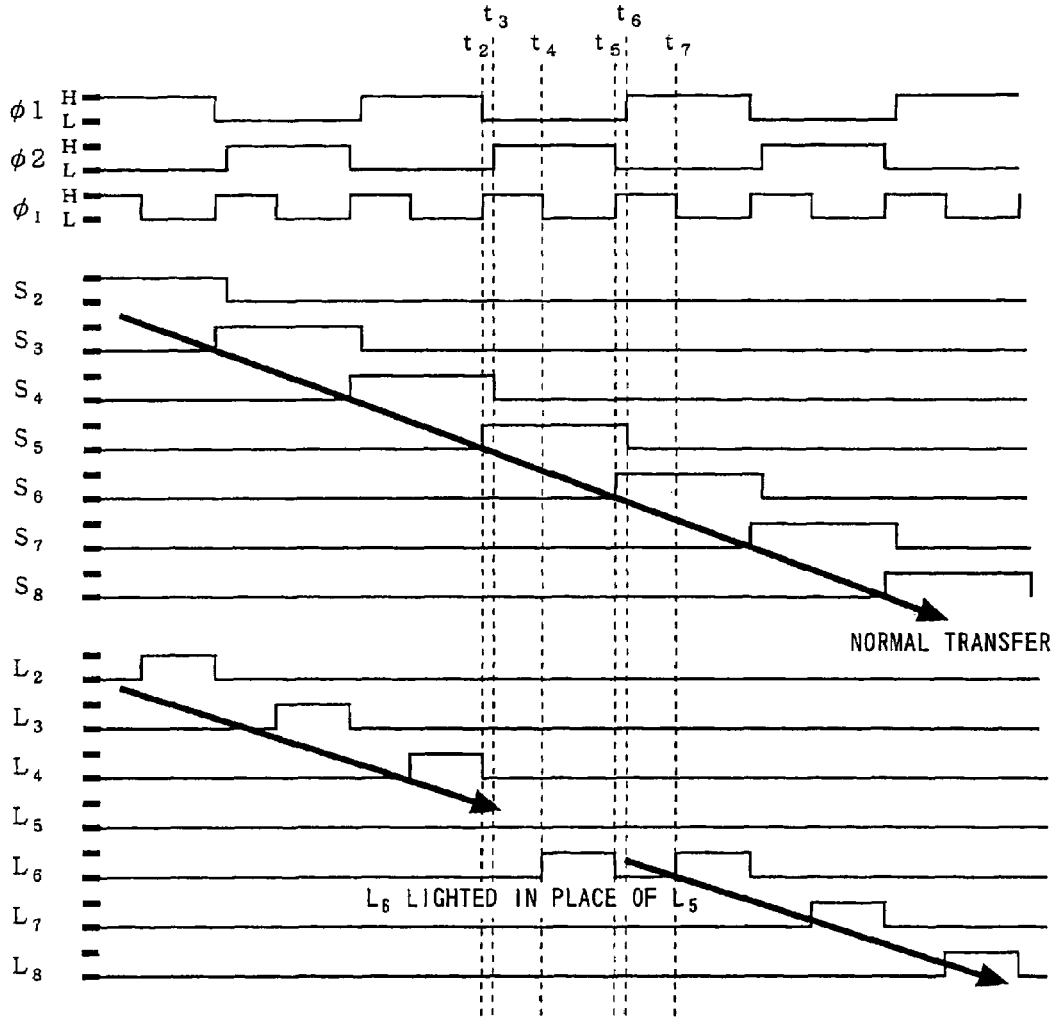
FIG. 5 shows the waveforms for illustrating the situation in which the thyristor $L_6$ is lighted in place of the thyristor $L_5$ in the light-emitting portion.

FIG. 4 shows the waveforms of the clock pulses $\phi$1, $\phi$2 and the light-emitting signal $\phi_I$. While the transfer period $T=t_5-t_2=500$ ns, the time period $t_a=t_3-t_2=20$ ns, the time period $t_b=t_4-t_3=20$ ns, $V_{GA}=-5$ volts, High-level voltage=0 volts, and Low-level voltage=−5 volts in the waveforms in FIG. 1B, the time period $t_b$ is spread to 80 ns in the waveforms in FIG. 4. Thereby, $g'_4(t_4)<g'_6(t_4)$ at the time $t_4$, so that the thyristor $L_6$ may be lighted in place of the failed thyristor $L_5$.

When the subsequent thyristor $S_6$ in the transfer portion is intended to be turned on at the time $t_5$, the gate voltage $g_6(t_5)$ of the thyristor $S_6$ at the time $t_5$ is the highest voltage among the gate voltages of the thyristors in the transfer portion connected to the $\phi$2 line 14, so that the thyristor $S_6$ may be turned on in order. As a result, the lightening of the thyristors after the thyristor $L_6$ may be transferred normally.

According to the waveforms shown in FIG. 4, when an image having a middle degree of concentration is outputted, a white stripe may be observed but it is not so remarkable. This is because that a white stripe corresponding to one dot is buried in an entire black area, and an image is an area gray scale in a low degree of concentration so that an effect due to the shift of one dot data is less.

Embodiment 2

The present embodiment is on the basis of the method (2) described above. A time period $t_c$ is provided between the time when the light-emitting signal $\phi_I$ becomes High-level and the time when both of the clock pulses $\phi$1 and $\phi$2 are at Low-level. The time period $t_c$ is selected to be larger than $\tau_c$ which is a time period required for the voltage of the gate $g_{n+1}$ of the thyristor $S_{n+1}$ becoming larger than the voltage of the gate $g_{n-1}$ of the thyristor $S_{n-1}$ in the transfer portion, so that the lighting of the thyristors after the thyristor $L_{n+1}$ may be transferred normally.

Figure 6:
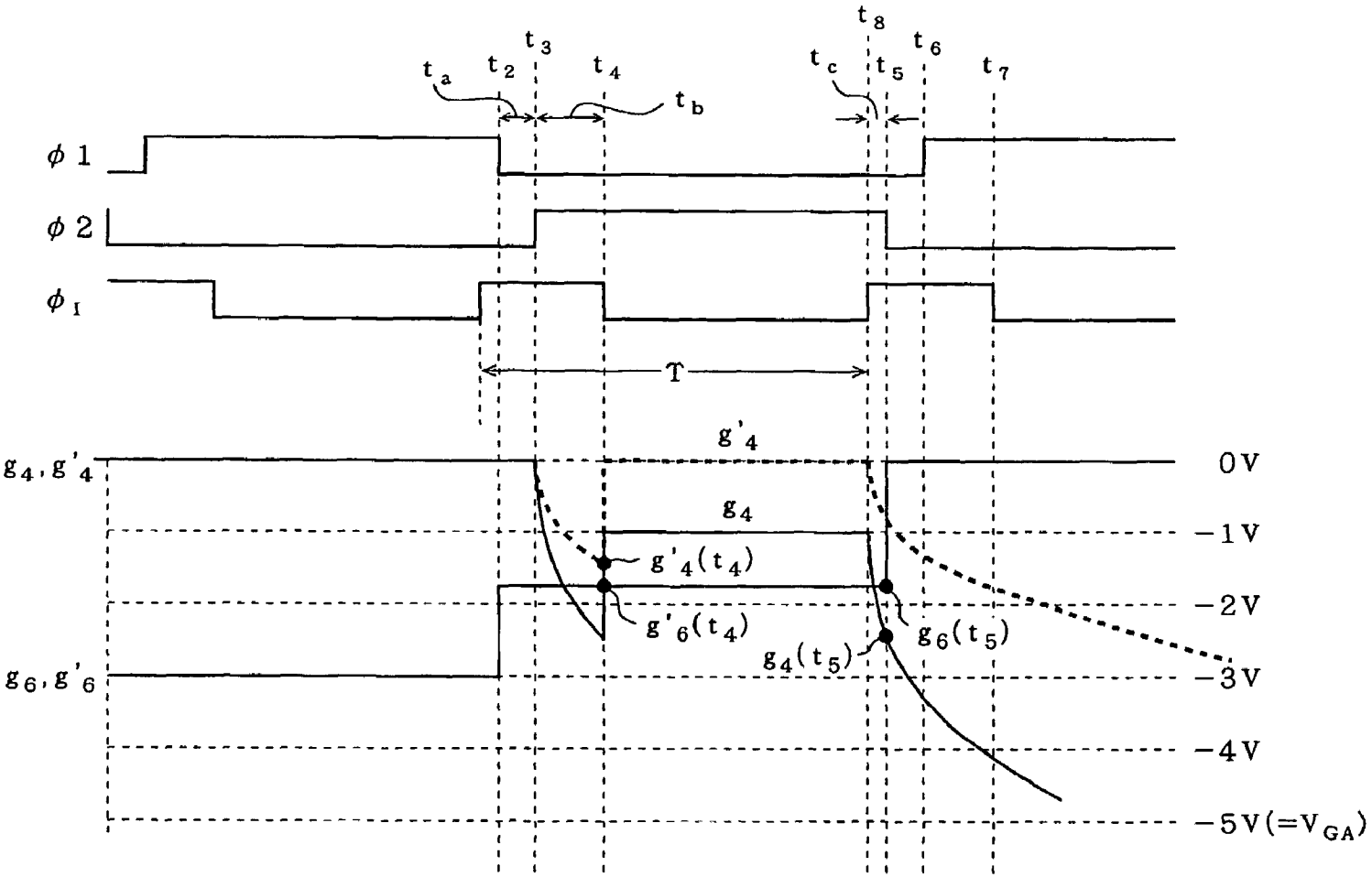
FIG. 6 shows the waveforms for illustrating the drive method in the embodiment 2.

FIG. 6 shows the waveforms of the clock pulses $\phi$1, $\phi$2 and the light-emitting signal $\phi_I$. The waveforms are the same as that in FIG. 3 except that the time when the light-emitting signal $\phi_I$ becomes High-level is caused to be faster by tc in comparison with the light-emitting signal $\phi_I$ shown in FIG. 3.

Figure 3:
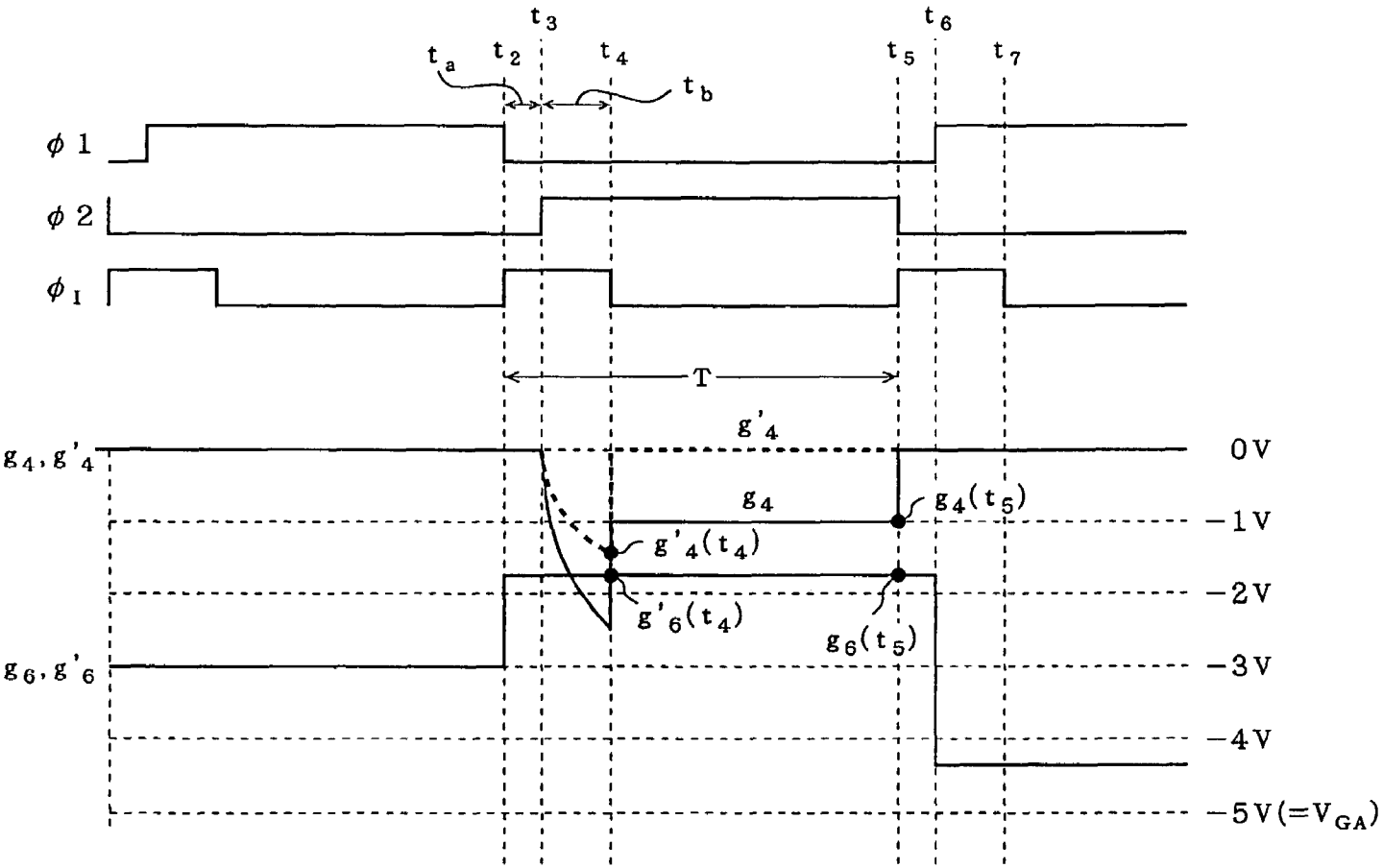
FIG. 3 shows the waveforms for illustrating the stop of transfer operation at the thyristor $L_4$ in the light-emitting portion in the self-scanning light-emitting element array in FIG. 2A.
Figure 7:
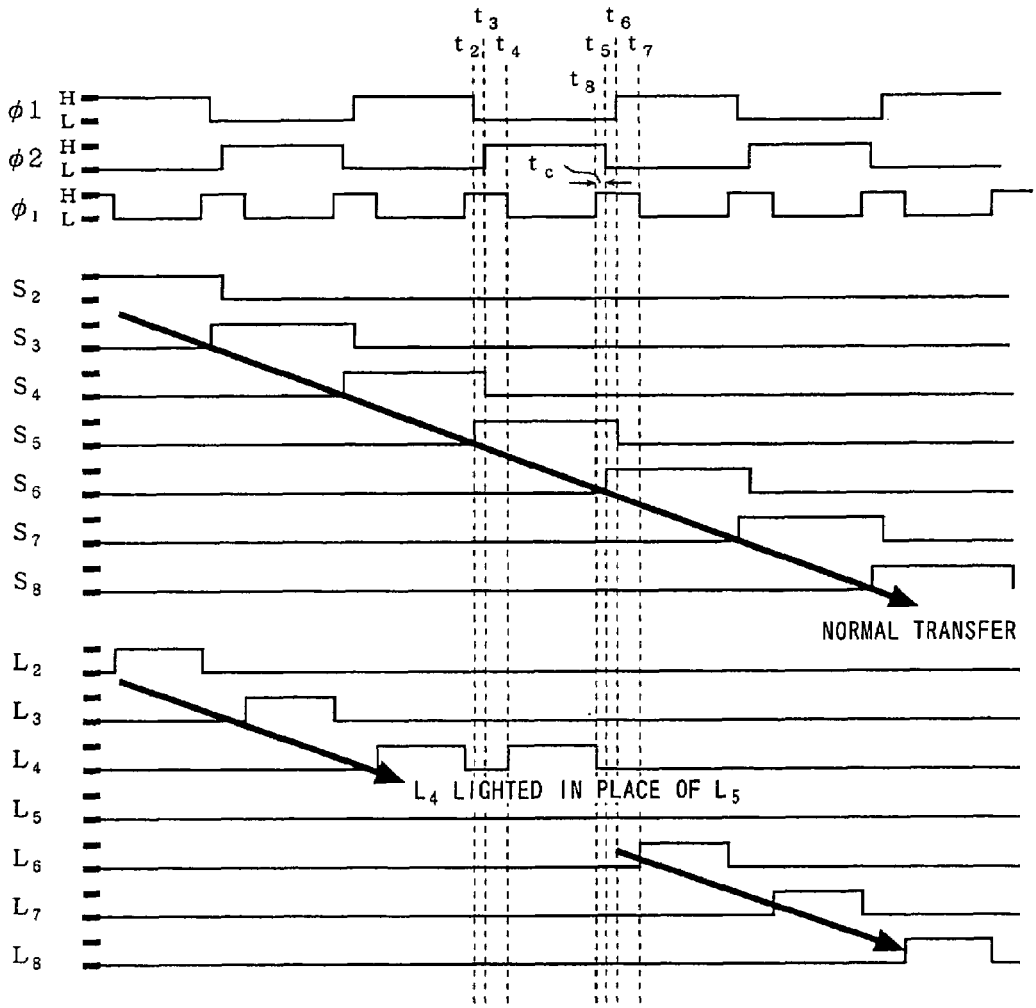
FIG. 7 shows the waveforms for illustrating the situation in which the thyristor $L_6$ is lighted in place of the thyristor $L_5$ in the light-emitting portion.

As illustrated with reference to the waveforms in FIG. 3, $g'_4(t_4)>g'_6(t_4)$ at the time $t_4$ as in the conventional waveforms. Therefore, the thyristor $L_4$ is lighted again in place of the failed thyristor $L_5$ in the light portion, and is lighted out at the time $t_5$ as shown in FIG. 7. Hereinafter, the clock pulse $\phi_2$ becomes Low-level at the time $t_6$ after the lapse of $t_c=t_5-t_8$, so that $g_6(t_5)>g_4(t_5)$. As a result, the thyristor $S_6$ is turned on subsequently to the thyristor $S_5$, and the thyristor $L_6$ is lighted to implement the normal transfer operation.

In the present embodiment, the difference between the gate voltages $g_4(t_8)$ and $g_6(t_8)$ at the time $t_8$ is small, so that it is allowable that a short time period $t_c$ is provided. The normal transfer operation is possible by $t_c=20$ ns in the waveforms shown in FIG. 6.

In the present embodiment 2, the time period during which the thyristor is lighted may be extended by 40 ns and the light exposure may be increased by approximately 10% in comparison with the embodiment 1.

The present invention may be applied to an optical writing head using a light-emitting element array chip. Also, the present invention is preferable for an optical printer and copy machine because the life time of an optical writing head is extended and the maintenance thereof may easily be implemented.

The invention claimed is:

1. A method for driving a self-scanning light-emitting element array including a transfer portion in which a plurality of three-terminal light-emitting thyristors are arrayed in one dimension, gates of neighbored thyristors are connected by a diode respectively, a power supply is connected to each gate of the thyristors through a load resistor, a first and second clock pulses of two phases are alternately supplied to cathodes or anodes of the thyristors; a light-emitting portion in which a plurality of three-terminal light-emitting thyristors are arrayed in one dimension, each gate of the thyristors is connected to a gate of corresponding thyristor in the transfer portion through a resistor, and a light-emitting signal is supplied to cathodes or anodes of the thyristors; the method comprising the steps of: turning on the thyristors in the transfer portion sequentially by the two-phase clock pulses; lighting the thyristor in the light-emitting portion corresponding to the turned-on thyristor in the transfer portion by the light-emitting signal; a first time period is provided, during which turned-on states of neighbored two thyristors are overlapped when the turned-on state is transferred in the transfer portion by the two-phase clock pulses; a second time period is provided after the first time period, during which the thyristor in the light-emitting portion corresponding to the turned-on thyristor in the transfer portion is lighted by the light-emitting signal; a third time period is provided after the second time period, during which a turned-off thyristor following the turned-on thyristor in the transfer portion is turned on as well as the lighted thyristor in the light-emitting portion is lighted out; and the second time period is a time period having a length in which when a thyristor to be lighted in the light-emitting portion is not lighted due to the breakage of a line, a thyristor following the failed thyristor due to the breakage of the line is lighted.

2. The method according to claim 1, wherein the second time period is determined by the variation of the gate voltages of the thyristor following the failed thyristor and the thyristor prior to the failed thyristor.

3. A method for driving a self-scanning light-emitting element array including a transfer portion in which a plurality of three-terminal light-emitting thyristors are arrayed in one dimension, gates of neighbored thyristors are connected by a diode respectively, a power supply is connected to each gate of the thyristors through a load resistor, a first and second clock pulses of two phases are alternately supplied to cathodes or anodes of the thyristors; a light-emitting portion in which a plurality of three-terminal light-emitting thyristors are arrayed in one dimension, each gate of the thyristors is connected to a gate of corresponding thyristor in the transfer portion through a resistor, and a light-emitting signal is supplied to cathodes or anodes of the thyristors; the method comprising the steps of: turning on the thyristors in the transfer portion sequentially by the two-phase dock pulses; lighting the thyristor in the light-emitting portion corresponding to the turned-on thyristor in the transfer portion by the light-emitting signal; a first time period is provided, during which turned-on states of neighbored two thyristors are overlapped when the turned-on state is transferred in the transfer portion by the two-phase clock pulses; a second time period is provided after the first time period, during which the thyristor in the light-emitting portion corresponding to the turned-on thyristor in the transfer portion is lighted by the light-emitting signal; a third time period is provided after the second time period, during which the lighted thyristor in the light-emitting portion is lighted out; a fourth time period is provided after the third time period, during which a thyristor following the turned-on thyristor in the transfer portion is turned on; and the fourth time period is a time period having a length in which when a thyristor to be lighted in the light-emitting portion is not lighted due to the breakage of a line, a thyristor prior to the failed thyristor due to the breakage of the line is lighted.

4. The method according to claim 3, wherein the fourth time period is determined by the variation of the gate voltages of the thyristor back to following the failed thyristor and the thyristor prior to the failed thyristor.

* * * * *